United States Patent [19]

Rechsteiner

[11] Patent Number: 4,655,407

[45] Date of Patent: Apr. 7, 1987

[54] OUTSIDE-IN WINDING APPARATUS

[75] Inventor: Emil B. Rechsteiner, Arlington, Mass.

[73] Assignee: Isoreg Corporation, Littleton, Mass.

[21] Appl. No.: 712,675

[22] Filed: Mar. 18, 1985

[51] Int. Cl.[4] ..... H01F 41/08; B65H 81/02

[52] U.S. Cl. ..... 242/4 A; 29/605; 242/7.03

[58] Field of Search ..... 242/4 R, 4 A, 7.03, 242/55.18; 29/605; 156/172, 185, 443, 463

[56] References Cited

U.S. PATENT DOCUMENTS

| | | | |
|---|---|---|---|
| 2,978,193 | 4/1961 | Kelly | 242/4 A |
| 3,000,580 | 9/1961 | Matovich, Jr. | 242/4 A |
| 3,050,266 | 8/1962 | Bucalo | 242/4 A |
| 3,191,878 | 6/1965 | Kitano | 242/4 R |
| 4,424,939 | 1/1984 | Ohashi | 242/4 R |

*Primary Examiner*—Billy S. Taylor
*Attorney, Agent, or Firm*—Joseph S. Iandiorio

[57] ABSTRACT

A winding apparatus for winding an element through a form which loads a coil of element through the form in a first direction to generate layers of the element in the coil, and unwinds the element from its layers in the coil and winds it under tension about the form in the opposite direction to wind a final coil. The apparatus uses a releasable retention mechanism responsive to a predetermined tension applied by the element for sequentially releasing successive portions of unwinding layers of the element as it is paid out from the loading coil to wind tightly about the form in response to an advancing region of maximum tension between the outer periphery of the final coil and the advancing point of separation of the element from the inner periphery of the loading coil.

34 Claims, 15 Drawing Figures

OUTSIDE-IN WINDING APPARATUS

FIELD OF INVENTION

This invention relates to the winding of an element through a form, and more particularly to a method and apparatus for winding cores and coils for electromagnetic induction devices and the like.

BACKGROUND OF INVENTION

Formation of loops or coils of a material passing through an opening of an object presents certain difficulties of manufacture. Constructing cores for electromagnetic induction devices such as transformers presents a typical manufacturing situation. One manufacturing method involves assembling individual core sections or segments to form a core that fills the opening and partially or wholly surrounds one or more transformer inductance coils. Another method involves winding a ribbon of material such as steel about a mandrel to preform the core in the desired shape, severing the core, and reassembling it to fill and surround the inductance coil.

Transformer cores constructed by winding a ribbon of transformer steel into a shape of a ring or a squared-off "O" offer certain advantages over transformer core assembled from individual laminar sections of transformer steel: "wound[ cores pack steel very tightly, hence permitting construction of transformers that are compact and that exhibit comparatively low electrical losses. Wound cores, moreover, allow rapid assembly of transformers and permit construction of transformers that are comparatively quiet.

However, wound cores have in the past had certain disadvantages. Compared with conventional laminar cores, pre-wound transformer cores are expensive as they require extensive manufacturing operations prior to their being available for transformer manufacturing. After winding about a mandrel is completed, the cores are annealed for many hours at high temperatures, often in a reduction atmosphere of hydrogen or nitrogen. The annealing process relaxes the strains introduced into the metal by the winding process.

Subsequent to annealing, the cores are subjected to a pressurized varnishing process and are then baked at elevated temperatures to cure the varnish. After baking, the cores typically are cut in a direction diametric to the direction of the wound steel and in a way that yields two pieces that eventually fit together precisely. After this cutting operation, the cut surfaces are often etched with acid to remove from the cut surface small metal burrs that result from the cutting action. Such burrs are undesirable because they tend to bridge the cut pieces of steel and, in service, tend to cause undesirable, heat-producing eddy-currents.

After etching of the cut surfaces, the pre-wound core pieces customarily are lapped at the cut surfaces, then are numbered for later matching of halves. They are then dipped in a plastic substance to protect the cut and etched surfaces from scratches and marring and to keep matching core pieces from being separated. When the cores are used in the manufacture of transformers, the two matching pieces are temporarily separated, and one or more inductance coils are arranged together with one or more wound cores to form a magnetic/electrical circuit such as is commonly used in transformers, inductors or saturable reactors. The previously cut core pieces are then customarily kept securely joined by means of a strapping band made of steel, stainless steel, or some other material exhibiting high tensile strength.

Other methods avoid previously winding the core by transferring core ribbon from a roll to form a coil larger in diameter yet thinner in thickness which, driven by friction rollers, revolves freely through the opening of the inductance coil. In some methods the coil is then simply increased in thickness to approach the outer bounds of the inductance coil opening. Other methods proceed, after the original roll is emptied, to continue revolving the coil in the same direction about a leg of the inductance coil after attaching a terminal end of the ribbon to the inductance coil. The ribbon thereby is wound directly about the inductance coil itself. In yet another method, the newly-formed coil is tightened by pulling the ribbon toward the original roll after attaching the terminal end to the inductance coil.

SUMMARY OF INVENTION

It is therefore an object of this invention to provide an improved apparatus for winding an element through one or more forms.

It is a further object of this invention to provide an improved apparatus for maintaining tension on the element as it is wound on the form.

It is a further object of this invention to provide an improved apparatus which advances the region of maximum tension on the element and advances its point of separation from the loading coil as the element is wound onto the form.

It is a further object of this invention to provide such an apparatus which maintains the integrity of the element.

It is a further object of this invention to provide an improved apparatus for manufacturing cores for inductance coils of electromagnetic devices.

It is a further object of this invention to provide an improved apparatus for manufacturing inductance coils that surround previously manufactured closed cores of electromagnetic devices.

It is a further object of this invention to provide such an improved apparatus which transfers the element to a coil through the form and then reverses the direction of rotation of the coil to wind the element about the form.

The invention results from the realization that a truly effective "outside-in" winding technique for winding an element from a loading coil to the final coil can be achieved by providing about the inside of the loading coil tensioning means which sequentially release successive portions of unwinding layers of the element as it is paid out from the loading coil to wind tightly about the form in response to an advancing region of maximum tension between the outer periphery of the final coil and the advancing point of separation of the element from the inner periphery of the loading coil.

This invention features a winding apparatus for winding an element through a form. There are means for loading a coil of the element through the form in a first direction to generate layers of the element in the coil and means for unwinding the element from its layers in the coil and winding it under tension about the form in the opposite direction to wind a final coil. Releasable retention means are responsive to a predetermined tension applied by the element for sequentially releasing successive portions of unwinding layers of the element as it is paid out from the loading coil to wind tightly about the form in response to an advancing region of maximum tension between the outer periphery of the final coil and the advancing point of separation of the element from the inner periphery of the loading coil.

In a preferred embodiment the means for loading includes a drive means for revolving the coil. The drive means are disposed about the outside of the coil and are biased inwardly against the coil, and the drive means include drive wheels and a drive motor for driving those wheels. The element may be a ribbon of metal and the drive means may alternatively be a traction belt which frictionally engages the coil, or the elements may be magnetic and the traction belt may include means for magnetically attracting the element in the coil.

The retention means are disposed about the inside of the coil and may include a plurality of retention roller assemblies, each having a pair of axially aligned adjacent roller sections. The retention roller assemblies may also include means for rotatably supporting the roller sections and means for selectively separating and reuniting the roller sections to provide a gap between the sections when separated for permitting transit of the element. Actuating means drive the means for separating and reuniting, and holding means prevent dislocation, including separation, of the sections until the predetermined tension occurs. The means for separating and reuniting may include linkage means responsive to a longitudinally applied force from the actuating means to move the sections axially, that is, laterally. The final form on which the element is wound may include at least one prewound inductive coil and the wound element may be the core of an electromagnetic device. Alternatively, the form about which the element is wound includes a previously completed core of ferromagnetic material and the element includes electrically conductive material. The means for loading may include a guide roller for guiding the element into a loading position, and the roller sections are cylindrical.

The invention also features a retention roller assembly for guiding the element under tension. It has at least one pair of axially aligned adjacent roller sections, means for rotatably supporting the roller sections, and means for selectively axially separating and reuniting the roller sections to provide a gap between the sections when separated for permitting transit of the element. Actuating means drive the means for separating and reuniting, and there are holding means for preventing dislocation, including separation, of the sections until a predetermined tension occurs.

The means for separating and reuniting may include linkage means responsive to the longitudinally applied force from the actuating means to move the sections axially, laterally. The actuator means may include a solenoid, and the means for separating and returning may include biasing means for urging the roller sections to the separation position. Each roller section may be cylindrical.

The actuating means may include a longitudinally movable drive member interconnected with the means for separating and reuniting, and means for driving the drive member between the extended, separated roller section position and the retracted, reunited roller section position. The means for driving the drive member may include an extension drive and a retraction drive. The drive member may be a piston, and the retraction drive may include biasing means for urging the piston to the retracted position.

The extension drive may include a piston chamber surrounding and guiding the piston, a source of pressurized fluid, and pressurizing valve means for introducing the pressurized fluid into the chamber to drive the piston into the extension position. The pressurizing valve means is operated in response to the piston leaving the retracted position and is closed in response to the piston entering the extended position. The actuating means also includes a relief valve for relieving the pressurized fluid in the chamber in response to the piston reaching the extended position. The relief valve may be disposed in the piston. The actuator means may further include a cam member proximate the extended position for operating the relief valve. Pressurizing valve means may include a port valve in the chamber wholly or partially restricted by the piston in the retracted position and uncovered as the piston leaves the retracted position. The pressurizing valve may further include an input valve between the port valve and the source of pressurized fluid, an extension limit cam and a retraction limit cam, both cams movable with the piston for operating the input valve. The drive member may be at least in part magnetic, and the holding means may include magnet means for attracting the drive member.

DISCLOSURE OF PREFERRED EMBODIMENTS

Other objects, features and advantages will occur from the following description of a preferred embodiment and the accompanying drawings, in which.

Figure 8B:
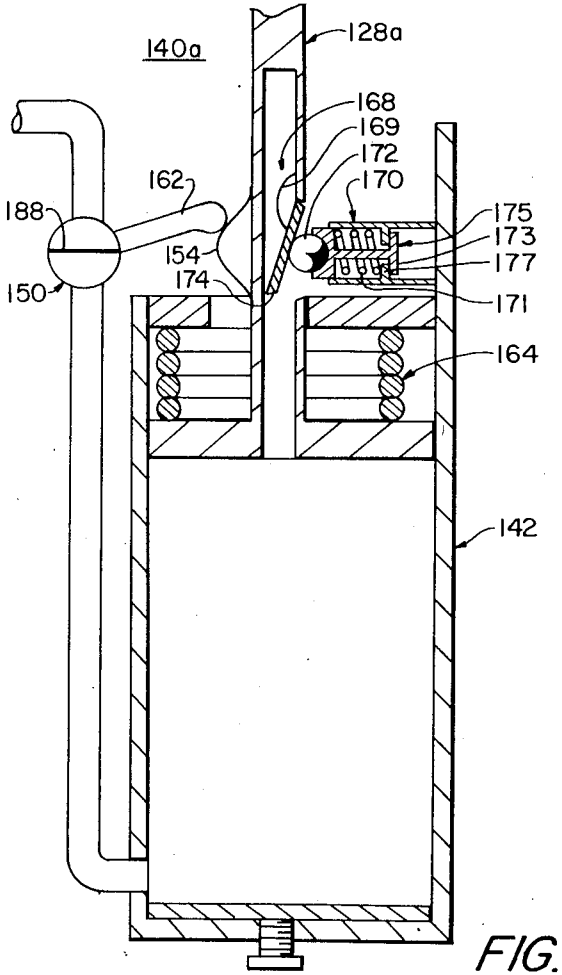
Figure 8A:
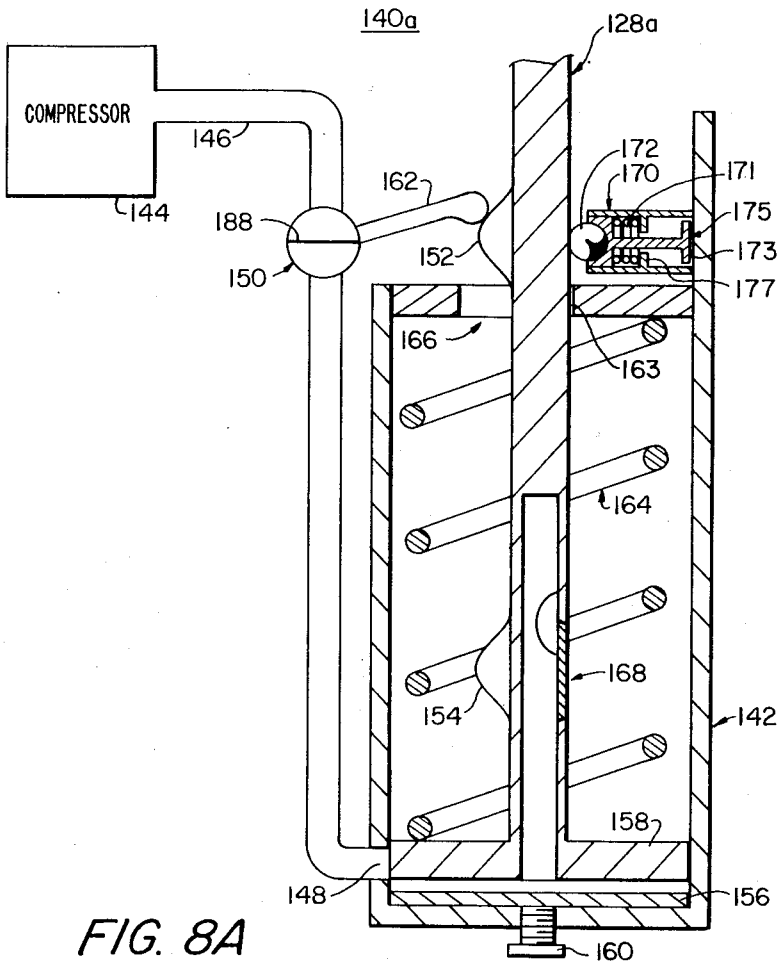
Figure 9:
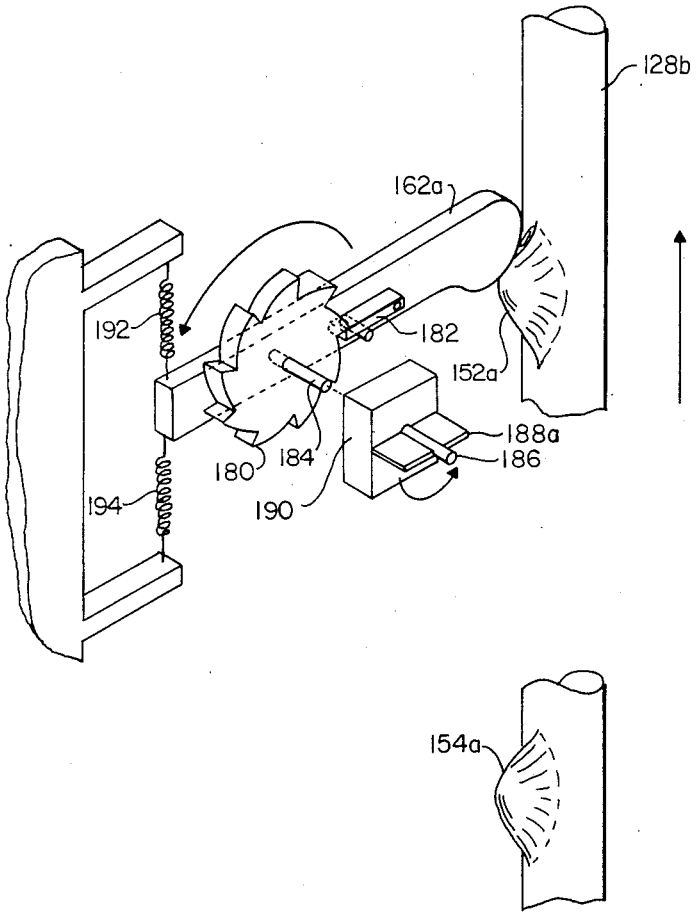
Figure 10:
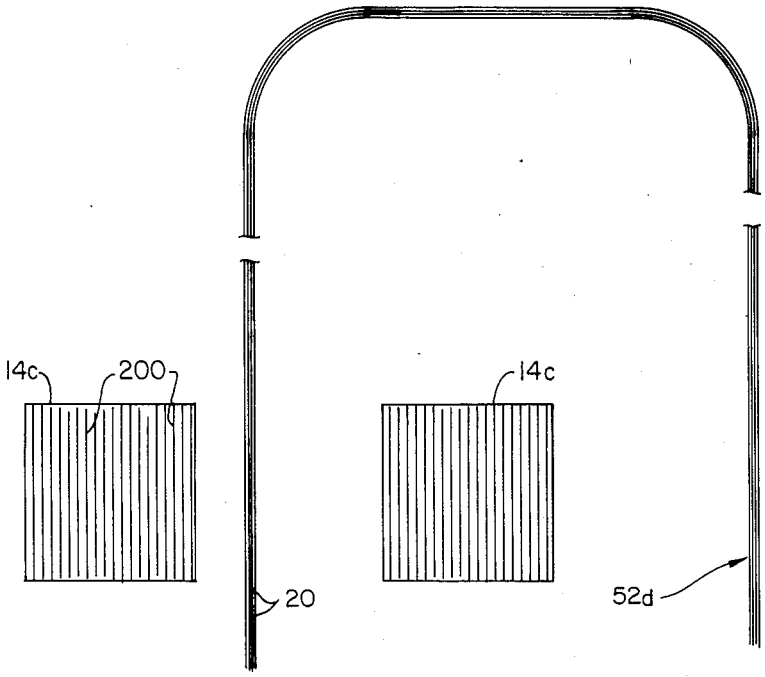

FIGS. 8A and 8B are cross-sectional views of the actuator of the retention roller assembly in the retracted and extended positions, respectively; FIG. 9 is a detailed schematic axonometric view of the input valve and lever arrangement for the actuator of FIGS. 8A and 8B; and FIG. 10 is a schematic cross-sectional view of an inductance core and a loading coil of conductor to be wound into an inductor on the core.

Figure 1A:
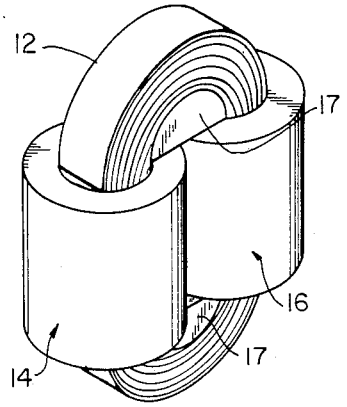
FIGS. 1A through 1C are axonometric views of arrangements of induction coil forms and elements wound as cores according to the invention.
Figure 1B:
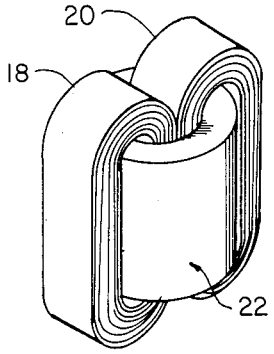
Figure 1C:
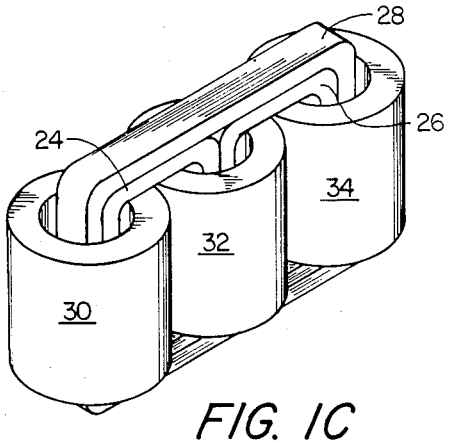

An apparatus according to the invention winds a flexible element through a form under tension. In one application, the element is ribbon-like ferromagnetic material wound to produce the core of a transformer or other magnetic device. One such arrangement is shown in FIG. 1A where core 12 has been formed through prewound electrical coils 14, 16. When used in a transformer, core 12 is formed from a ribbon of metal such as 0.01" steel or amorphous metal of the general type sold under the tradename Metglas. Cap 17 may be added to minimize tight radius bends for the core ribbon and to enable tighter association among layers of the ribbon and thereby reduce voids between those layers. Another arrangement is shown in FIG. 1B, where cores 18, 20 have been wound about and through coil 22. Yet another arrangement is shown in FIG. 1C, where cores 24, 26, and 28 have been wound through preformed coils 30, 32, 34 to form a three-legged core structure.

Figure 2:
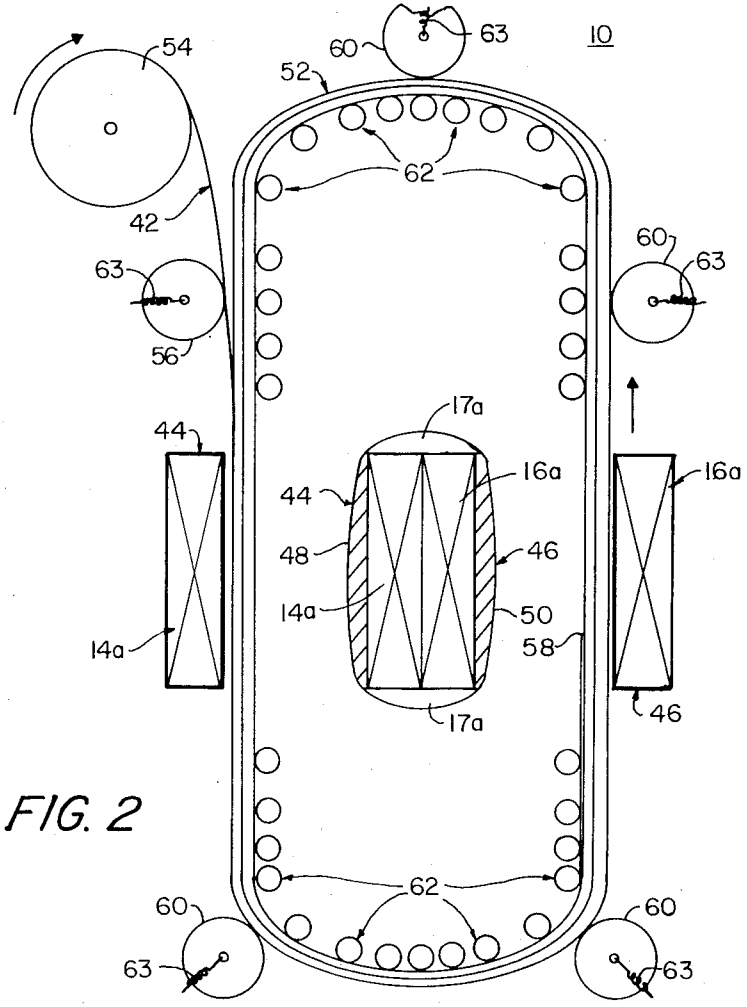
FIG. 2 is a cross-sectional view of a winding apparatus according to this invention in the process of forming an element into a loading coil of core material within two closed inductor coils.

Winding apparatus 10 according to this invention is shown in a cross-sectional view in FIG. 2 in the process of loading element 42 through coil forms 14*a* and 16*a*. Coils 14*a* and 16*a* are joined with bobbin cap 17*a* mounted upon bobbins 44 and 46, about which coils 14*a* and 16*a*, respectively, are wound. Bobbin 44 has convex side 48 and bobbin 46 has convex side 50 for further improving the geometry of the form by softening the angles of the form.

A temporary loading coil 52 is initiated by guiding start end 58 of element 42 from source coil 54 between guide roller 56 and the retention means such as retention roller assemblies 62. Only the roller portion of each roller assembly 62 is indicated in FIG. 2. End 58 then passes through coils 14*a* and 16*a* and between drive means, such as drive wheels 60 and retention roller assemblies 62, disposed about the inside of coil 52. Coil 52 revolves in a first direction, counter-clockwise as shown in FIG. 2, until coil 52 contains, in layers, a sufficient quantity of element 42 to wind the form. Start end 58 is temporarily attached to the innermost layer of coil 52. Drive wheels 60 and guide roller 56 are biased inwardly against coil 52 to define coil 52 in combination with retention rollers 62. Wheels 60 and roller 56 may be mounted with springs 63 to accomplish the inward bias and to allow outward growth of coil 52.

Figure 3:
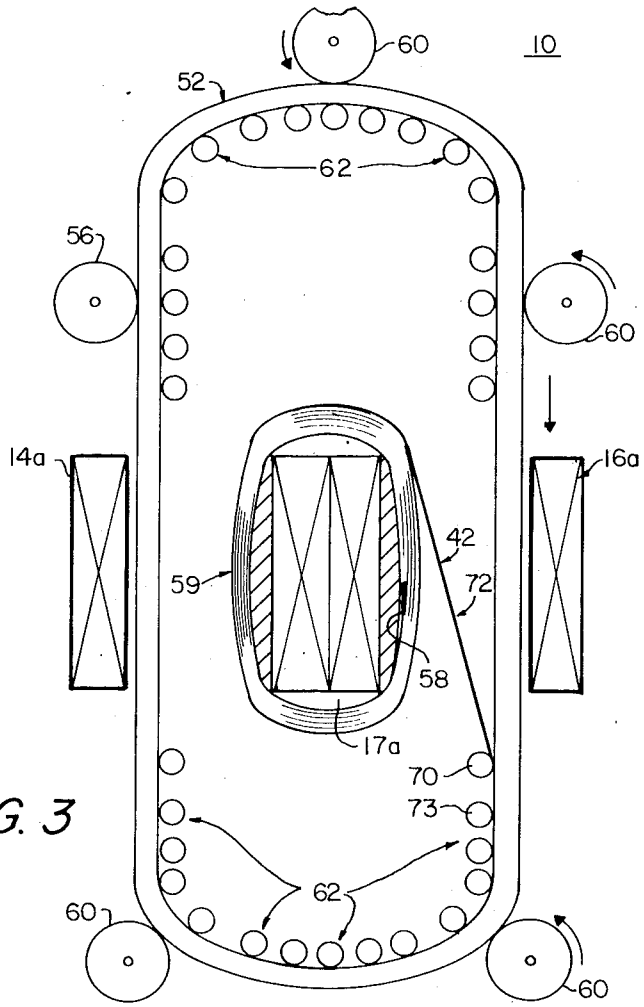
FIG. 3 is a view similar to FIG. 2 showing the unloading of the loading coil of the element and winding of the element about the form.

Once the necessary core material is loaded as coil 52, element 42 is severed from roll 54 and the severed end is temporarily attached to the outer periphery of loading coil 52. The original start 58 of loading coil 52 is detached and reattached to a fixed position about coils 14*a* and 16*a*, preferably at cap 17*a*. Drive wheels 60 are then reversed in direction to revolve coil 52 clockwise as shown in FIG. 3. Tension is created on the portion of element 42 attached to the inner form between start end 58 and the retention roller disposed at the inner periphery of the coil. As shown in FIG. 3, retention roller 70 is experiencing the region of maximum tension, region 72. Element 42 is unwound from coil 52 by sequentially releasing successive portions of element 42 as it is paid out to wind about the form. This advances region 72 in the direction of unwinding. The point of separation of element 42 from the inner periphery of loading coil 52 follows from the release of element 42 when tension of predetermined magnitude is exerted on retention roller 70. To release element 42, the roller portion of each retention roller assembly 62 includes a pair of axially aligned, adjacent roller sections which are axially, laterally separable to provide a gap between the sections to permit transit of element 42 between the sections. Element 42 separates from the inner periphery of loading coil 52 until it is restrained by successive retention roller section 73. The process of continuous release of element 42 from loading coil 52 is repeated through the successive parting of all retention roller assemblies 62 until virtually all of element 42 in loading coil 52 is transferred to final coil 59.

Once the core is fully wound as final coil 59, the outer end of element 42 is grasped with a tool (not shown) and held taut until it is fastened to the core by welding, bonding or clamping. The final, completely wound core produced by apparatus 10 is similar to the core shown in FIG. 1A.

Two or more cores may be wound simultaneously, using adjacent winding apparatuses according to this invention, to produce the three-legged cores shown in FIGS. 1B and 1C. Coils 30, 32, and 34, FIG. 1C, are clamped into fixed positions in a core winding apparatus. Core ribbon material for inner core section 24 is loaded into the apparatus and is then wound into a gap-free inner core, tightly embracing coils 30 and 32 and their caps, omitted for clarity in FIGS. 1C. This process is repeated with inner-core section 26. Instead of sequentially winding the cores, cores 24, 26 may be wound simultaneously using two winding apparatuses. The winding apparatus is then adjusted to permit winding of a core with a wider opening as is required of the outer core section 28. Alternatively the core and coil assembly is transferred to another winding apparatus that has retention rollers arranged to permit winding of such a wide-opening core. The exact required quantity of core ribbon material for the outer core section is loaded into the machine and is then unloaded to form the outer core section that tightly hugs the inner core sections 24 and 26.

Figure 4:
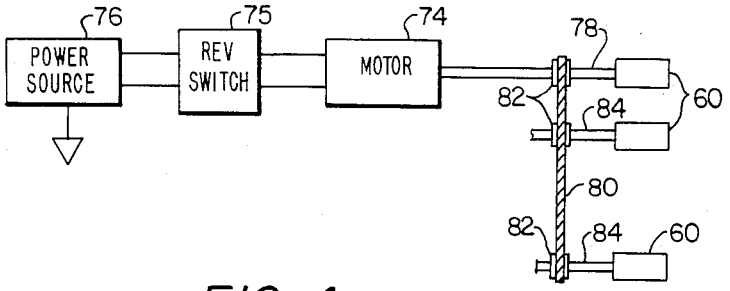
FIG. 4 is a side schematic view of a motor for driving the drive wheels of FIGS. 2 and 3.

Drive wheels 60 of FIGS. 2 and 3 may be driven by a motor such as electric motor 74 in FIG. 4. Motor 74, powered by power source 76, exerts a motive force to shaft 78. This force is distributed to the remaining drive wheels by drive belt 80 passing over pulleys 82. Motor 74 is bi-directional to permit formation of element 42 into loading coil 52 in one direction, FIG. 2, and then unloading of coil 52 in the opposite direction, FIG. 3. Its direction is controlled by reversing switch 75.

Figure 5A:
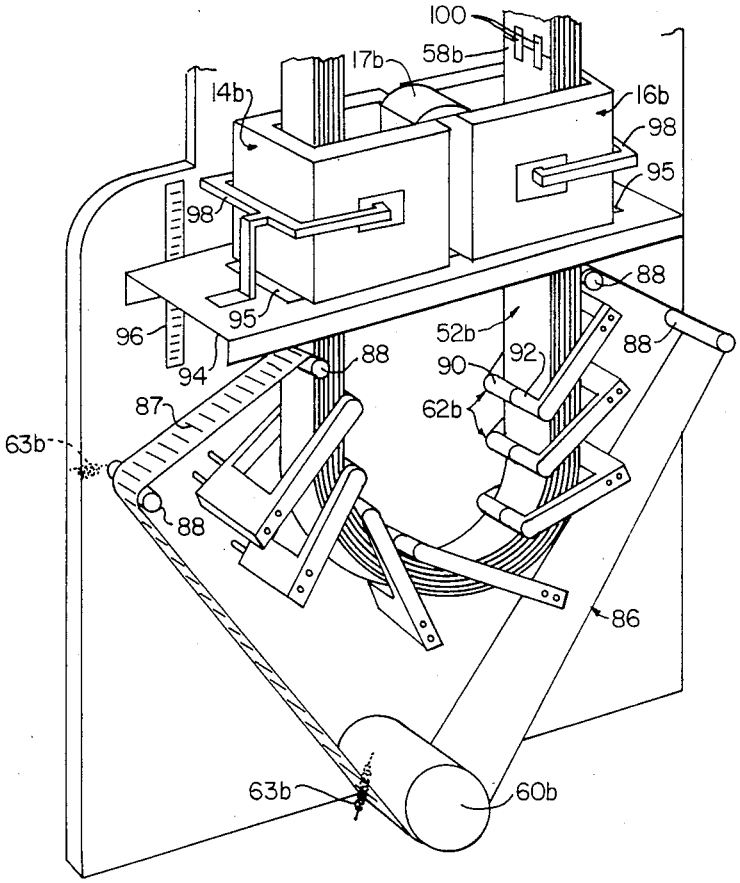
FIG. 5A is a more detailed partial axonometric view of the winding apparatus according to this invention using a different drive technique.
Figure 5B:
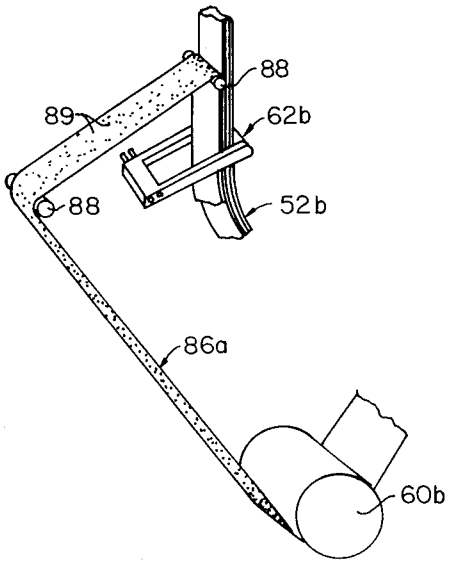
FIG. 5B is a schematic view of the winding apparatus showing yet another drive technique.

An alternative method of driving coil 52 is shown in partial axonometric view in FIG. 5A. Traction belt 86 engages coil 52*b* frictionally by means, for example, of a serrated rubber surface 87. Alternatively, belt 86 may include magnet material, such as discrete pieces or a powder of ceramic or ferromagnetic particles 89, FIG. 5B, embedded in belt 86*a* for attracting magnetic coil 52*b*. The term "magnetic" designates any ferromagnetic or other material capable of being magnetized or of being attracted by a magnet. Traction belt 86 is propelled by drive wheel 60*b* and is guided by traction belt guide and tensioners 88, FIGS. 5A and 5B. Drive wheel 60*b*, tensioners 88 are biased by springs 63*b*, shown in ghost, to maintain tension of traction belt 86 against loading coil 52*b*. Retention roller assemblies 62*b*, shown schematically, have a pair of axially aligned roller sections 90, 92, FIG. 5A. Form coils 14*b*, 16*b* are mounted upon shelf 94, which has openings 95 for admitting loading coil 58*b* and a lower coil cap (not shown). Shelf 94 is mounted upon adjustable positioners 96. Coils 14*b*, 16*b* and upper cap 17*b* are held in a fixed position with clamps 98. Adhesive tape 100 temporarily attaches start end 58*b* to the inside of coil 52*b*.

Figure 6:
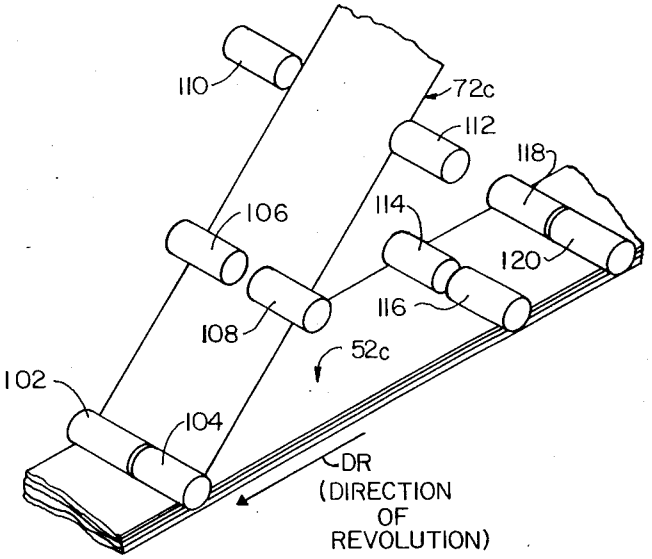
FIG. 6 is an axonometric view of a group of retention rollers during the winding cycle.

The sequential operation of the roller sections is portrayed in FIG. 6. The direction of revolution for coil 52*c* is indicated by arrow DR. Region 72*c* of maximum tension exerts its force upon roller sections 102, 104. When a predetermined tension is reached, the sections lift away and axially, laterally separate; these dislocations do not occur prior to that tension. Roller sections 106, 108 experienced the maximum tension of region 72*c* prior to sections 102, 104. Sections 106, 108 upon lifting away slightly relaxed the tension of region 72c before maximum tension was transferred to sections 102, 104. Sections 106, 108 begin separating and will eventually separate similarly to sections 110, 112, the latter having separated sufficiently to accommodate transit of the innermost loop of loading coil 52c. These sections then begin their descent as presently indicated by sections 114, 116, shown descending toward the next innermost loop of coil 52c. Sections 118, 120 are fully reunited and reinstalled against the next innermost loop of coil 52c. Sections 102, 104 through 118, 120 therefore illustrate one entire cycle of separation and reunion for given roller sections of a retention roller assembly.

Figure 7B:
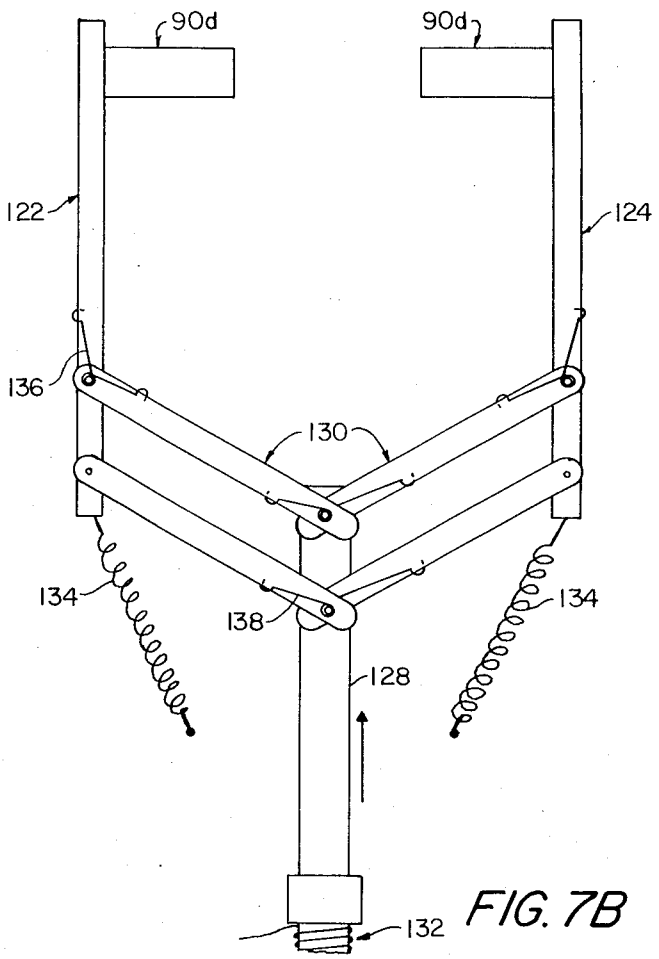
FIG. 7B is such a view of the retention roller assembly partially opened.
Figure 7A:
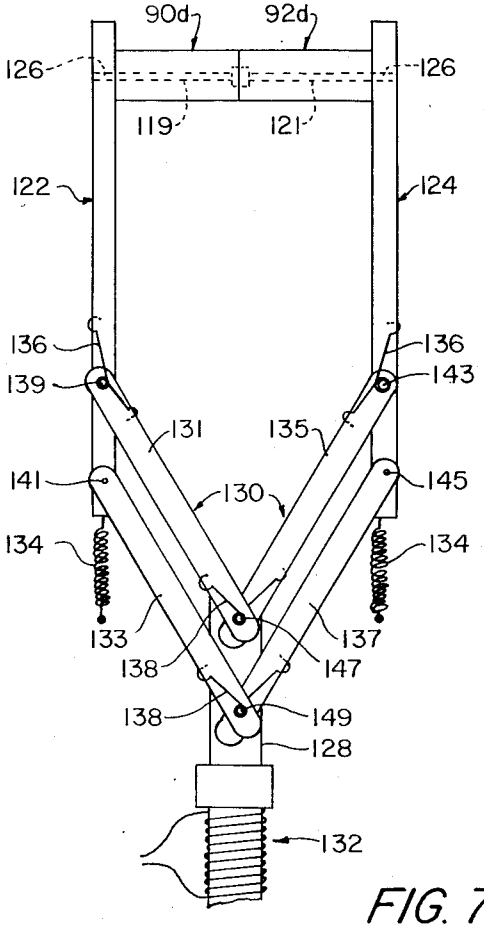
FIG. 7A is a side elevational view of a retention roller assembly in closed position.

One arrangement of the retention roller assembly is shown in FIG. 7A. Roller sections 90d, 92d are rotatably supported on arms 122, 124 by journal shafts 119, 121, shown in phantom, which may have ball or roller bearings 126 for allowing rotation of the roller sections. Roller sections 90d, 92d are separated by the action of drive member 128 upon linkage 130. Linkage 130 includes two pairs of parallel links 131, 133 and 135, 137 pivotably mounted to arms 122 and 124, respectively, by shafts 139, 141, 143 and 145, and to drive member 128 by shafts 147, 149. Drive member 128 is actuated by solenoid 132. As drive member 128 is extended, resilient anchor or holdback springs 134 urge separation of roller sections 90d, 92d by restraining the travel of arms 122, 124, allowing linkage 130 to exert an outward or lateral force to separate the sections. Coil springs 134, prehensile springs 136, 138 urge reunion of the roller sections. In the separated condition, FIG. 7B, drive member 128 is extended away from solenoid 132, anchor springs 134 are restraining upward motion of arms 122, 124 such that linkage 130 has forced separation of roller sections 90d, 92d. When solenoid 132 no longer drives member 128 upwards, springs 136, 138 urge reunion of roller sections 90d, 92d.

Instead of a solenoid, the retention roller assembly may include an actuator utilizing pressurized fluid. Actuator 140a, FIG. 8A, includes a drive member in the form of piston 128a and piston chamber 142 surrounding and guiding piston 128a. Piston 128a is guided in part by bearing surface 163 of chamber 142. Compressor 144 supplies compressed air through air supply line 146 which enters chamber 142 at port valve 148. A pressurizing valve mechanism for introducing the pressurized air into chamber 142 includes input valve 150, retraction limit cam 152, and extension limit cam 154. Piston 128a is shown in the retracted position, retaining together the retention roller sections, such as sections 90d, 92d, FIG. 7A. Holding plate 156 prevents extension of piston 128a, and thus separation and other dislocations of the associated roller sections, until a predetermined tension occurs upon those roller sections. Piston head 158 is magnetic and holding plate 156 includes a permanent magnet which applies a predetermined force upon head 158. The force applied by plate 156 is adjustable using screw 160 which varies the distance between plate 156 and the retraction position of piston head 158. Adjustability of the holding force is desirable to accommodate elements of different width and material.

After tension applied by the element on retention roller sections reaches a predetermined level, piston head 158 is drawn away from holding plate 156, and retraction limit cam 152 operates lever 162 of input valve 150 to rotate valve vane 188 to open the valve and allow compressed air to enter through port valve 148. Rotating tip 172 of cam 170 turns against the shaft of piston 128a as it travels, urged by spring 171. Flange 173 of shaft 175 does not approach shoulder 177 at this time. Through initial extension of piston 128a, valve 148 is no longer blocked by piston head 158. Piston 128a rapidly extends pneumatically and compresses spring 164. Cam 154 passes through opening 166 in chamber 142. Bearing surface 163 surrounds the circumference of piston 128a not otherwise surrounded by opening 166. When piston 128a reaches the extended position, cam 154 operates lever 162 to rotate valve vane 188 to close valve 150. Relief valve 168 is operated by relief cam 170, FIG. 8B, to vent the pressure beneath piston 128a when it reaches full extension. Cam 170 has rotating tip 172 which is urged by spring 171 against shaft 128a until port door 174 of relief valve 168 is reached. Cam 170 overcomes spring 169 to open port door 174. The outward travel of cam roller 172 is limited by the flange 173 on shaft 175 engaging with shoulder 177. The pressurized air passes through the hollow stem in piston 128a and escapes through relief valve 168, allowing biasing spring 164 to urge retraction of the piston. Relief valve 168 recloses and, during the down stroke of shaft 128a, cam 152 slides past lever 162.

As shown schematically in FIG. 9, lever 162a is engaged by cam 152a and cam 154a only during extension of shaft 128b. This selective action may be accomplished by ratchet wheel 180, which is engaged by ratchet lock 182 of lever arm 162a only upon upward motion of ratchet lock 182. Rotation of ratchet wheel 180 turns shaft 184. Shaft 186, which controls valve vane 188a, is responsive to shaft 184 through gear box 190. The gear ratio within box 190 causes valve vane 188a to rotate 90° when ratchet wheel 180 is upwardly engaged by ratchet lock 182. Lever arm 162a, urged by springs 192, 194, returns to a horizontal position after cam 152a rises past it. During full extension, cam 152a moves valve vane 186 to an open position and cam 154a moves it to a closed position. During retraction, first cam 154a and then cam 152a slide past lever arm 162a without moving valve van 186 from its closed position.

Although the form has been described as a prewound inductive coil and the element as a core of a transformer, this is not a limitation of the invention. Form 14c, FIG. 10, is a previously wound magnetic core, having layers 200 seen in cross section. Layers 202 in loading coil 52d include electrically conductive material, such as copper or aluminum foil, which will be wound about form 14c to form an inductive coil. The foil may be coated with a varnish or other insulating material providing electrical separation between the layers of the element once they are wound in a final coil about core form 14c. Alternatively, the element may be formed from a number of adjacent, parallel wires held together by adhesive material to form a ribbon.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A winding apparatus for winding an element through a form comprising:

means for loading a coil of said element through said form in a first direction to generate layers of said element in said loading coil, said means for loading including drive means for revolving said loading coil and structure for mounting said drive means about the outside of said loading coil and for biasing said drive means inwardly against said loading coil;

means for unwinding said element from its layer in said loading coil and winding it under tension about said form in the opposite direction to wind a final coil; and releasable retention means responsive to a predetermined tension applied by said element for sequentially releasing successive portions of unwinding layers of said element as it is pair out from said loading coil to wind tightly about said form in response to an advancing region of maximum tension between the outer periphery of said final coil and the advancing point of separation of said element from the inner periphery of said loading coil, said retention means including structure for mounting said retention means about the inside of said loading coil.

2. The winding apparatus of claim 1 in which said drive means includes a motor.

3. The winding apparatus of claim 1 in which said element is a ribbon of metal.

4. The winding apparatus of claim 1 in which said drive means includes drive wheels.

5. The winding apparatus of claim 1 in which said drive means includes a traction belt.

6. The winding apparatus of claim 5 in which said traction belt frictionally engages said coil.

7. The winding apparatus of claim 1 in which said retention means is a plurality of retention roller assemblies, each having a pair of axially aligned, adjacent roller sections.

8. The winding apparatus of claim 1 in which said form includes at least one pre-wound inductive coil and said wound element is the core of an electromagnetic device.

9. The winding apparatus of claim 1 in which said form includes at least one previously completed core of magnetic material and in which said element includes electrically conductive material.

10. The winding apparatus of claim 1 in which said means for loading includes a guide roller for guiding said element into a loading position.

11. The winding apparatus of claim 7 in which said roller sections are cylindrical.

12. A winding apparatus for winding an element through a form comprising:

means for loading a coil of said element through said form in a first direction to generate layers of said element in said coil;

means for unwinding said element from its layers in said coil and winding it under tension about said form in the opposite direction to wind a final coil; and a plurality of retention roller assemblies responsive to a predetermined tension applied by said element for sequentially releasing successive portions of unwinding layers of said element as it is paid out from said loading coil to wind tightly about said form in response to an advancing region of maximum tension between the outer periphery of said final coil and the advancing point of separation of said element from the inner periphery of said loading coil, each said roller assembly having a pair of axially aligned, adjacent roller sections, mounted by structure about the inside of the coil, and including:

means for rotatably supporting said roller sections;

means for selectively axially separating and reuniting said roller sections to provide a gap between said sections when separated for permitting transit of said element;

actuating means for driving said means for separating and reuniting; and holding means for preventing dislocation, including separation, of said sections until said predetermined tension occurs.

13. The winding apparatus of claim 12 in which said means for separating and reuniting includes linkage means responsive to a longitudinally applied force from said actuating means to move said sections axially, laterally.

14. The winding apparatus of claim 12 in which said means for loading includes drive means for revolving the coil and includes structure for mounting said drive means about the outside of the coil and for biasing said drive means inwardly against the coil.

15. A retention roller assembly for guiding an element under tension comprising:

at least one pair of axially aligned, adjacent roller sections;

means for rotatably supporting said roller sections;

means for selectively axially separating and reuniting said roller sections to provide a gap between said sections when separated for permitting transit of said element;

actuating means for driving said means for separating and reuniting; and holding means for preventing dislocation, including separation, of said sections until a predetermined tension occurs.

16. The retention roller assembly of claim 15 in which said means for separating and reuniting includes linkage means responsive to a longitudinally applied force from said actuating means to move said sections axially, laterally.

17. The retention roller assembly of claim 15 in which said actuating means includes a solenoid.

18. The retention roller assembly of claim 15 in which said means for separating and reuniting includes biasing means for urging said roller sections to the separation position.

19. The retention roller assembly of claim 15 in which each roller section is cylindrical.

20. The retention roller assembly of claim 15 in which said actuating means includes a longitudinally movable drive member interconnected with said means for separating and reuniting, and means for driving said drive member between an extended, separated roller section position and a retracted, reunited roller section position.

21. The retention roller assembly of claim 20 in which said means for driving said drive member includes an extension drive and a retraction drive.

22. The retention roller assembly of claim 21 in which said drive member is a piston.

23. The retention roller assembly of claim 22 in which said retraction drive includes biasing means.

24. The retention roller assembly of claim 22 in which said extension drive includes a piston chamber surrounding and guiding said piston, a source of pressurized fluid, and pressurizing valve means for introducing the pressurized fluid into said chamber to drive said piston to the extended position.

25. The retention roller assembly of claim 24 in which said pressurizing valve means is opened in response to said piston leaving the retracted position and is closed in response to said piston entering said extended position.

26. The retention roller assembly of claim 25 in which said actuating means includes relief valve means for relieving the pressurized fluid in said chamber in response to said piston reaching the extended position.

27. The retention roller assembly of claim 25 in which said relief valve is disposed in said piston.

28. The retention roller assembly of claim 27 in which said actuating means further includes a cam member proximate the extended position for operating said relief valve.

29. The retention roller assembly of claim 25 in which said pressurizing valve means includes a port valve in said chamber restricted by said piston in the retracted position and uncovered as said piston leaves said retracted position.

30. The retention roller assembly of claim 29 in which said port valve is totally restricted by said piston in the retracted position.

31. The retention roller assembly of claim 29 in which said pressurizing valve means further includes an input valve between said port valve and said source of pressurized fluid, and an extension limit cam and a retraction limit cam, both cams movable with said piston for operating said input valve.

32. The retention roller assembly of claim 20 in which said drive member is at least in part magnetic and said holding means includes magnet means for attracting said drive member.

33. The retention roller assembly of claim 24 in which the source of pressurized fluid provides pneumatic pressure.

34. A winding apparatus for winding a magnetic element through a form comprising:

means for loading a coil of said element through said form in a first direction to generate layers of said element in said coil, said means for loading including drive means for revolving the coil and structure for mounting said drive means about the outside of the coil and for biasing said drive means inwardly against the coil, said drive means including a traction belt having magnetic means for attracting the element in the coil;

means for unwinding said element from its layers in said coil and winding it under tension about said form in the opposite direction to wind a final coil; and releasable retention means responsive to a predetermined tension applied by said element for sequentially releasing successive portions of unwinding layers of said element as it is paid out from said loading coil to wind tightly about said form in response to an advancing region of maximum tension between the outer periphery of said final coil and the advancing point of separation of said element from the inner periphery of said loading coil.

* * * * *